US008448286B2

(12) United States Patent
Driesen et al.

(10) Patent No.: US 8,448,286 B2
(45) Date of Patent: May 28, 2013

(54) BRISTLE TUFTS AND TOOTHBRUSH WITH BRISTLE TUFTS

(75) Inventors: Georges Driesen, Weilrod (DE); Ivo Kunath, Kronberg (DE)

(73) Assignee: Braun GmbH, Kronberg (DE)

( * ) Notice: Subject to any disclaimer, the term of this patent is extended or adjusted under 35 U.S.C. 154(b) by 740 days.

(21) Appl. No.: 12/642,203

(22) Filed: Dec. 18, 2009

(65) Prior Publication Data

US 2010/0293734 A1 Nov. 25, 2010

(30) Foreign Application Priority Data

Dec. 19, 2008 (EP) ..... 08022101

(51) Int. Cl.

| | |
|---|---|
| ***A46B 9/04*** | (2006.01) |
| ***A46B 9/06*** | (2006.01) |
| ***A46D 1/00*** | (2006.01) |

(52) U.S. Cl.

USPC ..... 15/167.1; 15/207.2; 15/DIG. 6; 116/208; 428/397

(58) Field of Classification Search

USPC ... 15/167.1, 207.2, DIG. 6; 116/208; 428/397
See application file for complete search history.

(56) References Cited

U.S. PATENT DOCUMENTS

| | | | | |
|---|---|---|---|---|
| 3,103,679 | A * | 9/1963 | Clemens | 15/167.1 |
| 3,263,258 | A | 8/1966 | Burge | |
| 3,613,143 | A | 10/1971 | Muhler et al. | |
| 4,802,255 | A | 2/1989 | Breuer | |
| 5,268,005 | A * | 12/1993 | Suhonen | 8/504 |
| 5,313,909 | A | 5/1994 | Tseng | |
| 5,933,906 | A * | 8/1999 | Rackley | 15/167.1 |
| 5,987,691 | A * | 11/1999 | Jurt et al. | 15/167.1 |
| 6,141,819 | A * | 11/2000 | Driesen et al. | 15/207.2 |
| 6,412,139 | B1 | 7/2002 | Weihrauch | |
| 6,496,999 | B1 | 12/2002 | Gleason | |
| 6,871,373 | B2 * | 3/2005 | Driesen et al. | 15/167.1 |
| 7,014,800 | B2 | 3/2006 | Weihrauch | |
| 7,503,093 | B2 | 3/2009 | Weihrauch | |

FOREIGN PATENT DOCUMENTS

| | | | |
|---|---|---|---|
| EP | 0035796 | | 9/1981 |
| GB | 1169106 | | 10/1969 |
| GB | 2323026 | | 9/1998 |
| GB | 2375705 | | 11/2002 |
| JP | 2005000310 | | 4/2005 |
| JP | 2005103184 | | 4/2005 |
| JP | 2006-204890 | * | 8/2006 |
| JP | 2006-255068 | * | 9/2006 |
| WO | WO 9725902 | | 7/1997 |
| WO | WO9838889 | | 9/1998 |
| WO | 99/24649 | * | 5/1999 |
| WO | 2004/002267 | * | 1/2004 |
| WO | 2008/035713 | * | 3/2008 |

OTHER PUBLICATIONS

Partial machine translation of WO 99/24649, May 20, 1999.*

* cited by examiner

*Primary Examiner* — Mark Spisich
(74) *Attorney, Agent, or Firm* — Vladimir Vitenberg

(57) ABSTRACT

A bristle cluster for a toothbrush is provided. The bristle cluster includes a number of bristles of a first type and a number of bristles of a second type. The bristles of the first type have wear characteristics that differ from the wear characteristics of the second type. The bristles of the first type have a wear indicator which causes a color change of the bristles, and the bristles of the second type, upon continuous mechanical stress, undergo a visible mechanical change and the free ends of the bristles of the second type are designed to be capable of being longitudinally fanned out.

9 Claims, 4 Drawing Sheets

BRISTLE TUFTS AND TOOTHBRUSH WITH BRISTLE TUFTS

FIELD OF THE INVENTION

The invention relates to a bristle cluster for a toothbrush with a number of bristles of a first type and a number of bristles of a second type, wherein the bristles of the first type have a wear characteristic that differs from the wear characteristic of the second type. The invention further relates also to a toothbrush with bristle clusters of this type.

BACKGROUND OF THE INVENTION

From U.S. Pat. No. 3,263,258, a bristle cluster is know which is formed from bristles with differing diameters. By using bristles with differing diameters in a bristle cluster, the cleaning ability of the toothbrush should be improved because the thinner bristles can penetrate more easily into the interdental spaces, while the thicker bristles serve to clean dental regions that are easier to reach.

From both U.S. Pat. Nos. 5,313,909 and 4,802,255, toothbrushes are known in which the bristles of the toothbrush are made of what is known as "indicator filaments". The indicator filaments have a colored region, wherein the use of the toothbrush leads to a change in the color of the colored region as the toothbrush continues to be used. The change in the color serves to indicate the wear on the toothbrush.

OBJECT OF THE INVENTION

The object of the invention is to provide a bristle cluster for toothbrushes in which the wear on the toothbrush will be particularly evident to the user.

SOLUTION

The solution to this object is achieved with a bristle cluster of the type described above, in which the bristles of the first type are subject to a color change with continuous use and the bristles of the second type are subject to a visible mechanical change with continuous use.

By using different indicators of wear within one bristle cluster, the wear is even more clearly and precisely visible. In this way, the end of the recommended period of use of the toothbrush can be more precisely evident to the user of the toothbrush. Moreover, this will prevent various brushing behaviors and/or various brushing techniques from distorting the actual end of the recommended period of use by indicating wear.

Preferably the bristles of the first type have different characteristics with respect to mechanical wear than the bristles of the second type. This can be dependent on differing geometry, cross-sections or surface structures of the bristles. Furthermore, the cross-sectional area of the bristles of the second type can be smaller than the cross-sectional area of the bristles of the first type.

The free ends of the bristles of the second type are designed such that they are capable of being fanned out. To this end, the free end of the bristles of the second type could have at least one predetermined breaking point, wherein the continued mechanical stress on the bristles of the second type would cause the free end of the bristle of the second type to fan out. Additionally, the bristles of the second type can have a color changing wear indicator. The mechanical alteration of the bristles of the second type can also be a deformation, wherein the deformation is a bending of the bristles of the second type.

BRIEF DESCRIPTION OF THE FIGURES

Additional features, application possibilities and advantages of the invention are evident from the following description of exemplary embodiments, which are shown in the illustrations.

DETAILED DESCRIPTION OF THE FIGURES

Figure 1A:
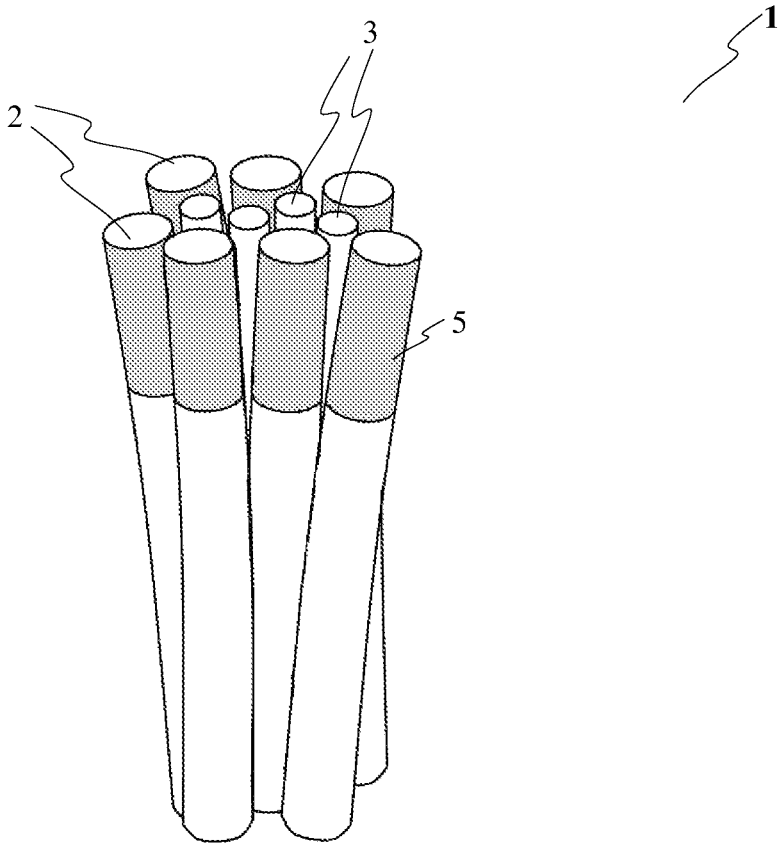
FIG. 1*a* shows a bristle cluster with coarse bristles of the first type with colored wear indicators and fine bristles of the second type.

FIG. 1*a* is a perspective view of a first exemplary embodiment of a bristle cluster 1. The bristle cluster 1 consists of a quantity of bristles, wherein a number of bristles of the first type 2 and a number of bristles of the second type 3 are present. The bristles of the first type 2 each have a color changing wear indicator 5. The color changing wear indicator 5 is essentially characterized in that as the period of use of the toothbrush progresses, the color of the wear indicator changes so that, when a predetermined color of the wear indicator is reached, the color white, for example, this signals the user that the recommended period of use for the toothbrush has been reached, or that the bristles are worn out.

The bristles of the second type 3 are arranged essentially in the inner region of the bristle cluster 1. The bristles of the second type 3 have a smaller cross-section or diameter than the bristles of the first type 2. As the period of use of the toothbrush progresses, this smaller diameter of the bristles 3 causes the mechanical wear on them to be different than on the considerably coarser bristles of the first type 2. For example, towards the end of the recommended period of use of the toothbrush, the mechanical wear could cause bristles of the second type 3 to become bent. In this way, in addition to the color signal of the wear indicator 5, the user of the toothbrush receives a further indication that the end of the recommended period of use of the toothbrush has been reached.

By using differing bristles in a bristle cluster, each of which is subjected to different types of wear, the wear of the bristles and therefore the recommended period of use of a toothbrush is indicated to the user even more clearly and more precisely.

Figure 1B:
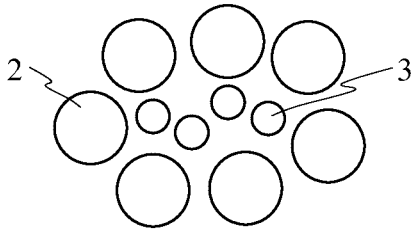
FIG. 1*b* is a top view of the bristle cluster shown in FIG. 1*a;*

FIG. 1*b* illustrates in cross-section the bristle cluster 1 shown in FIG. 1*a*. As can be seen here, the coarse bristles of the first type 2 are arranged in the outer region of the cluster 1, while the fine bristles of the second type 3 are arranged in the inner region of the bristle cluster 1. Of course, the bristles of the first type 2 and the bristles of the second type 3 can be arranged differently from this in the bristle cluster. For example, the coarse bristles 2 can be arranged such that they are surrounded by a number of finer bristles 3. Furthermore, a random arrangement of the coarser bristles 2 and the finer bristles 3 within the bristle cluster 1 is possible.

Figure 2A:
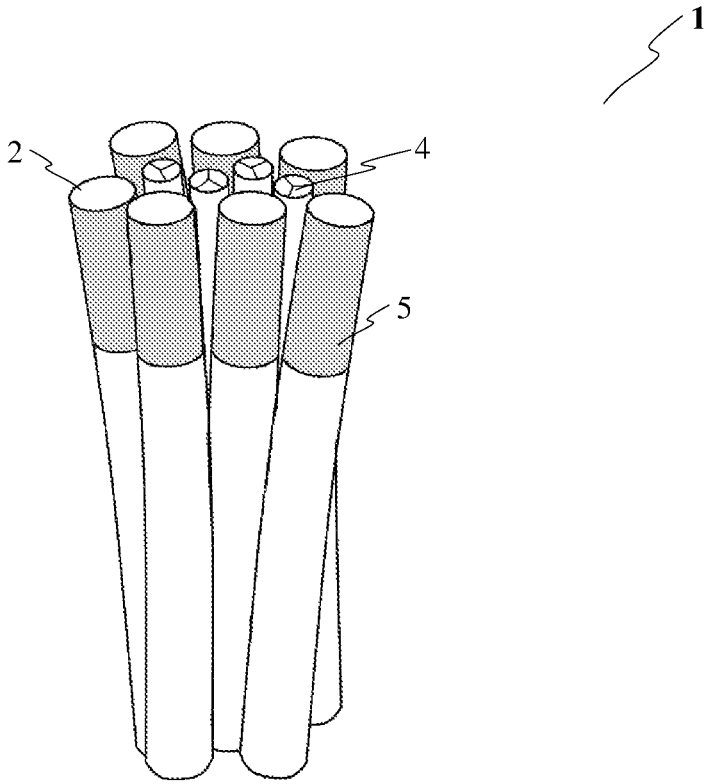
FIG. 2*a* shows a bristle cluster with coarse bristles of the first type with colored wear indicators and fine fanned bristles of the second type.

FIG. 2*a* shows an exemplary embodiment of a bristle cluster 1. The bristle cluster 1 consists of a number of first bristles 2, each of which have a colored wear indicator 5, as shown in FIG. 1*a*, and a number of second bristles 4 which are arranged in the interior of the bristle cluster 1, and therefore are surrounded by the bristles 2 of the first type. In the illustrated exemplary embodiment, the bristles 4 of the second type have a smaller diameter than the bristles 2 of the first type. Moreover, the free ends of the bristles 4 of the second type are designed to be fanned out longitudinally.

In this exemplary embodiment of a bristle cluster 1, as with the exemplary embodiment illustrated in FIG. 1*a*, the user receives, by means of the color changing wear indicator, a first indication of the end of the recommended period of use. A further indication of the end of the recommended period of use is given to the user by means of the bristles 4 of the second type. The bristles of the second type 4 are designed such that the free end of these bristles fan out near the end of the recommended period of use.

Figure 2B:
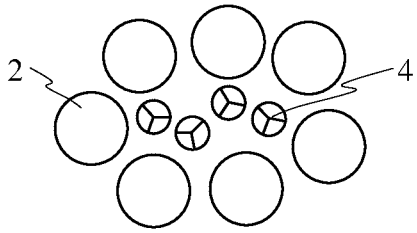
FIG. 2*b* is a top view of the bristle cluster shown in FIG. 2*a*.

FIG. 2*b* shows a cross-section through the bristle cluster shown in FIG. 2*a*. The fine bristles 4 which are capable of being fanned out are arranged here so as to be surrounded by the coarse bristles that have colored wear indicators 5. A different arrangement of the bristles of the first type 2 and the bristles 4 of the second type is also possible here. Moreover, the bristles 4 of the second type are smaller in diameter than the bristles 2 of the first type. For this reason, it is possible to produce an additional indication of wear, besides the mechanical wear of the bristles 4 of the second type by free end of these bristles fanning out , for example by bending as shown in the exemplary embodiment in FIG. 1*a*.

Figure 3:
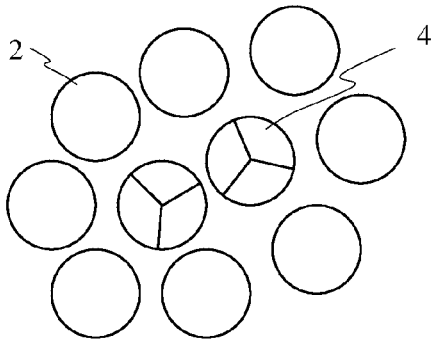
FIG. 3 shows a top view of an alternative variation of a bristle cluster according to FIG. 2*a*, wherein the bristles of the second type capable of being fanned out have the same diameter as the bristles of the first type.

The diameter of the bristles of the second type 4 in the non-fanned out condition can be the same as the diameter of the bristles 2 of the first type. FIG. 3 shows a cross-section through this type of bristle cluster with bristles of the second type 4 capable of being fanned out.

Figure 4A:
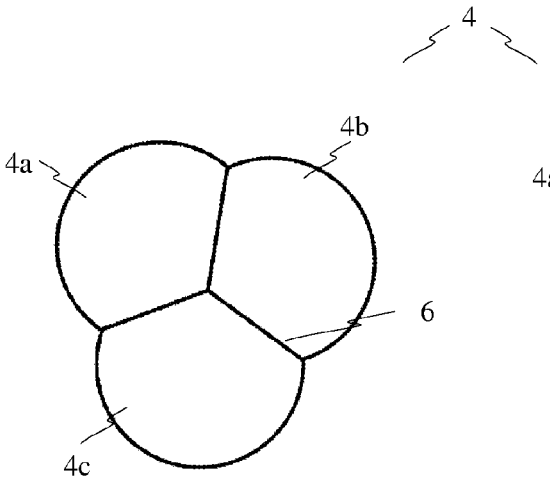
FIG. 4*a* shows a cross-section of a further variant of bristles capable of being fanned out.

While FIGS. 2 and 3 show two bristles 4 capable of being fanned out with an essentially circular cross-sectional surface, FIG. 4*a* shows a cross-section of a further exemplary embodiment of a bristle 4 capable of being fanned out, wherein the bristle has an essentially clover leaf shaped cross-sectional surface. The upper portion of the free end of the bristle 4 capable of being fanned out consists here essentially of three bristle segments 4*a*, 4*b*, 4*c*, designed to be longitudinally identical, wherein the three bristle segments are initially joined together longitudinally. In their upper region, the bristles 4 have three predetermined breaking points 6, along which the bristles 4 can be fanned out. The predetermined breaking points 6 are designed so that they can be fanned out only near the end of the recommended period of use of the toothbrush, or so that bristles fray along the predetermined breaking point gradually over time.

Figure 4B:
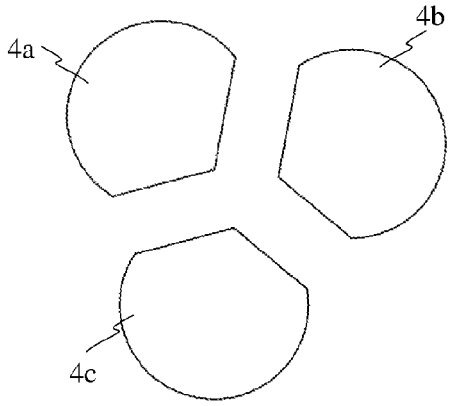
FIG. 4*b* shows the bristle capable of being fanned out according to FIG. 4*a* in the fanned out condition.

FIG. 4*b* shown in cross-section the bristle 4 capable of being fanned out in FIG. 4*a*, in the fanned out condition. The three bristle segments 4*a*, 4*b*, 4*c* have separated from each other along the predetermined breaking points 6.

Figure 5:
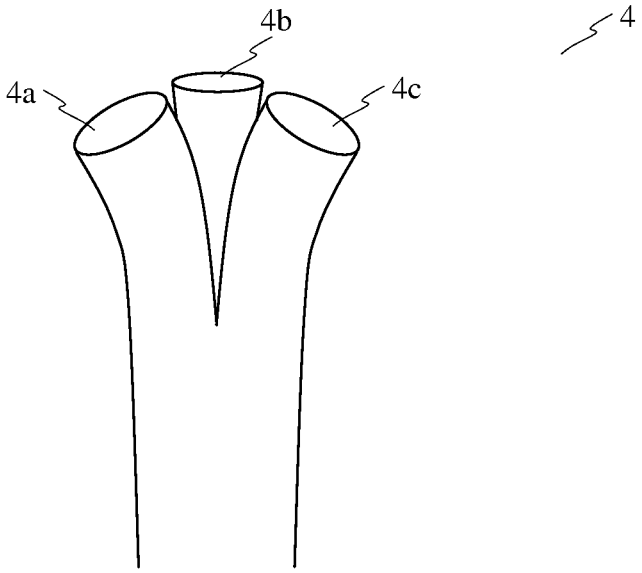
FIG. 5 is a schematic representation of a fanned out bristle.

FIG. 5 shows a perspective view of a bristle 4 capable of being fanned out in the fanned out condition. The circular bristle segments 4*a*, 4*b*, 4*c* shown here have separated from each other along the predetermined breaking points and thus form points sticking out of the bristle clearly recognizable to the user of the toothbrush.

The described bristle clusters can be used both in manual toothbrushes and in electric toothbrushes. Preferably, the free ends of the bristles are rounded (not shown in the drawings), in order to avoid damage to the gums as much as possible while brushing.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bristle cluster for a toothbrush having two independent wear indicators, the bristle cluster comprising a number of indicator bristles of a first type and a number of indicator bristles of a second type, wherein each of the indicator bristles of the first type comprises a colored region having wear characteristics that differ from the wear characteristics of the indicator bristles of the second type, wherein the colored region has a wear indicator which causes a predefined color change of the colored region, and the indicator bristles of the second type, upon continuous mechanical stress, undergo a predefined visible mechanical change comprising fanning out along predetermined lines of weakness after a predefined recommended period of use, so that the two independent wear indicators provide a user with a combined indication of the end of the recommended period of use of the bristle cluster.

2. The bristle cluster according to claim 1, wherein the bristles of the second type have at least one predetermined breaking point in the region of its free end, which fans out due to continuous mechanical stress on the bristles of the second type.

3. The bristle cluster according to claim 1, wherein the mechanical change will be recognizable after a predetermined period of use the toothbrush.

4. The bristle cluster according to any of claim 1, wherein the cross sectional area of the bristles of the second type is smaller than the cross sectional area of the bristles of the first type.

5. The bristle cluster according to claim 1, wherein the bristles of the second type have a color changing wear indicator.

6. The bristle cluster according to claim 1, wherein the bristles of the first type have different characteristics related to mechanical wear than the bristles of the second type.

7. The bristle cluster according to claim 1, wherein the bristles of the first type have a circular cross section, and the bristles of the second type have a non-circular cross section.

8. The bristle cluster according to claim 1, wherein the free ends of the bristles of the first and/or the second type are rounded.

9. A toothbrush with a bristle cluster according to claim 1.

* * * * *